US009453651B2

(12) United States Patent
Park et al.

(10) Patent No.: US 9,453,651 B2
(45) Date of Patent: Sep. 27, 2016

(54) AIR CONDITIONER WITH IONIZER

(71) Applicant: LG ELECTRONICS INC., Seoul (KR)

(72) Inventors: Dongryul Park, Seoul (KR); Kyungsoo Yoon, Seoul (KR); Jangwoo Lee, Seoul (KR); Bongjo Sung, Seoul (KR); Jongseong Gwak, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 581 days.

(21) Appl. No.: 14/027,497

(22) Filed: Sep. 16, 2013

(65) Prior Publication Data

US 2014/0094108 A1 Apr. 3, 2014

(30) Foreign Application Priority Data

Sep. 28, 2012 (KR) ..... 10-2012-0109094

(51) Int. Cl.
*F24F 7/007* (2006.01)
*F24F 3/16* (2006.01)

(52) U.S. Cl.
CPC ..... *F24F 7/007* (2013.01); *F24F 3/16* (2013.01); *F24F 2003/1682* (2013.01)

(58) Field of Classification Search
CPC ..... F24F 2003/1682; F24F 3/16; F24F 7/007
USPC ..... 454/341
See application file for complete search history.

(56) References Cited

FOREIGN PATENT DOCUMENTS

| | | | |
|---|---|---|---|
| CN | 1769808 | A | 5/2006 |
| CN | 201488140 | U | 5/2010 |
| CN | 101749800 | A | 6/2010 |
| CN | 201551620 | U | 8/2010 |
| CN | 102089590 | A | 6/2011 |
| JP | 2003-336871 | A | 11/2003 |
| JP | 2005-114195 | A | 4/2005 |
| JP | 2005-156027 | A | 6/2005 |

*Primary Examiner* — Steven B McAllister
*Assistant Examiner* — Reginald McNeill, II
(74) *Attorney, Agent, or Firm* — Dentons US LLP

(57) ABSTRACT

The present invention relates to an air conditioner with an ionizer which comprises: an ionizer to generate ions mounted in the vicinity of an air outlet, a carrier to move the ionizer, and a controller to control the ionizer and the carrier. The controller controls the carrier to move the ionizer to an initial point when power is supplied to the air conditioner or the power is changed from turn off to turn on. The controller can control a position of the ionizer with the carrier in response to a sensing signal of a sensor which senses a position of a person. Accordingly, a range of ion diffusion can be controlled efficiently, and by making the ions to be discharged to a specific direction the user presents thereto, effective improvement of an ion effect the user feel can be improved.

17 Claims, 6 Drawing Sheets

AIR CONDITIONER WITH IONIZER

This application claims priority to Korean Application No. 10-2012-0109094, filed on Sep. 28, 2012, which is incorporated by reference, as if fully set forth herein.

BACKGROUND

1. Field

The present invention relates to an air conditioner with an ionizer, and more specifically the present invention relates to an air conditioner having a movable ionizer arranged in the vicinity of an air outlet.

2. Related Art

As environmental pollution becomes the worse, people having different respiratory disease or showing allergy reaction caused by polluted air increases the more. Consequently, various attempts, such as generation of anions, have been made for cleaning the polluted air to improve a quality of the air.

Since the anion, a molecule of oxygen, nitrogen, or so on having a negative charge, is very beneficial for a human body, and effective for removal of dust and odor, an ionizer module is additionally mounted to, and used in, different types of domestic appliances, such as an air conditioner, or air cleaner.

Referring to FIG. 1, as an example, mounted in the vicinity of an air outlet of a wall mounting type air conditioner 20 additionally, there may a small sized modular ionizer 10 for generating at least one of anion and cation.

Referring to FIG. 2, the ionizer 10 may be mounted to a stand type air conditioner 30 in the vicinity of an air outlet thereof in a small sized modular mode for generating at least one of the anion and the cation.

However, since the ionizer 10 is mounted secured to a side, i.e., a left side or a right side, of the air outlet of the domestic appliance, such as the air cleaner or the air conditioner due to limitation of a mounting space, diffusion of the ions carried by air being discharged is limited, and, moreover, since the ions are discharged in a direction, not relevant to a position of a user, the ionizer 10 has a problem in that the user fails to feel an effect of the anion, properly.

SUMMARY

Accordingly, the present invention has been made in an effort to solve the aforementioned problems, and it is an object of the present invention to provide an air conditioner which makes ions generated by an ionizer to diffuse effectively owing to an air flow.

It is another object of the present invention to provide an air conditioner which makes ions to be forwarded to a person in a room, effectively.

The present invention provides an air conditioner including an ionizer to generate ions mounted on a vicinity of an air outlet, a carrier to move the ionizer, and a controller to control the ionizer and the carrier.

In accordance with an embodiment of the present invention, the air conditioner may further comprise a front chassis, and the ionizer is mounted on an inside of the front chassis.

In accordance with an embodiment of the present invention, the carrier includes a step motor and a lead screw, and the ionizer may move interlocked with the lead screw when the motor rotates the lead screw.

In accordance with an embodiment of the present invention, the step motor and the lead screw may be mounted on an inside of the air outlet.

In accordance with an embodiment of the present invention, the controller may control the carrier to move the ionizer to an initial position when power is supplied to the air conditioner or the power is changed from turn off to turn on.

In accordance with an embodiment of the present invention, the controller may control a position of the ionizer with a number of pulses applied to the step motor from the initial position.

In accordance with an embodiment of the present invention, the air conditioner may further include a sensor to sense a position of a person, and the controller may control the position of the ionizer through the carrier in response to a sensing signal of the sensor.

In accordance with an embodiment of the present invention, the sensor may be one of an ultrasonic sensor, an infrared sensor, and a heat sensor.

In accordance with an embodiment of the present invention, the sensor may be mounted to a front of the air conditioner.

In accordance with an embodiment of the present invention, the controller may determine a range a person presents with respect to the air conditioner with the sensor, and may control the carrier to make the ionizer to reciprocate within the range determined by the controller.

In accordance with an embodiment of the present invention, if the controller sets the ionizer to reciprocate, the controller may control the ionizer to increase an ion generation rate when the ionizer passes the range the person presents with respect to the air conditioner.

In accordance with an embodiment of the present invention, if the controller sets the ionizer to reciprocate, the controller may increase strength of air flow from the air conditioner when the ionizer passes the range the person presents with respect to the air conditioner.

In accordance with an embodiment of the present invention, the air conditioner may further comprise an input unit, wherein an operation mode among a plurality of operation modes are set through the input unit.

In accordance with an embodiment of the present invention, the operation mode may be a water fall mode in which the controller controls an operation of the ionizer to set an ion generation rate to a highest, as well as move a position of the ionizer to a center of the air conditioner, to diffuse the ions at the center, and the controller sets an air flow rate of the air conditioner to be higher than other modes among the plurality of modes.

In accordance with an embodiment of the present invention, the operation mode may be a sleeping mode in which the controller controls an operation of the ionizer to set an ion generation rate to a lowest, as well as move a position of the ionizer to a left side and a right side of the air conditioner alternately at predetermined time intervals, to spread the generated ions.

In accordance with an embodiment of the present invention, the air conditioner may further include a vane driver to drive a vane which controls a direction of air being discharged, and the controller may control the carrier to reciprocate the ionizer periodically, controls the vane driver to swing the vane periodically, and synchronizes a reciprocating period of the ionizer and a swing period of the vane at a predetermined ratio to distribute ion concentration uniformly.

In accordance with an embodiment of the present invention, the air conditioner may further include a vane driver to drive the vane which controls a direction of the air being discharged, and the controller may move the position of the ionizer taking a position the person presents with respect to the air conditioner determined by the controller with the sensor and the controller may take into account direction of the vane in a state the vane is set to swing.

In accordance with an embodiment of the present invention, when the vane rotates to direct the air to a right side, the controller may control the carrier to position the ionizer at a left side, and, when the vane rotates to direct the air to the left side, the controller may control the carrier to position the ionizer at the right side.

DETAILED DESCRIPTION OF THE INVENTION

In what follows, an ionizer according to preferred embodiments of the present invention will be described in detail with reference to the appended drawings.

The air conditioner in accordance with an embodiment of the present invention may have a movable ionizer mounted in the vicinity of an air outlet. For an example, the air conditioner of the present invention may include an ionizer for generating ions, and a carrier for moving the ionizer. In the specification, the air conditioner is a machine for controlling a temperature, humidity, and an air quality of a space having an air cleaner, an air heater, an air cooler, a humidifier, a fan, and so on mounted therein.

Figure 1:
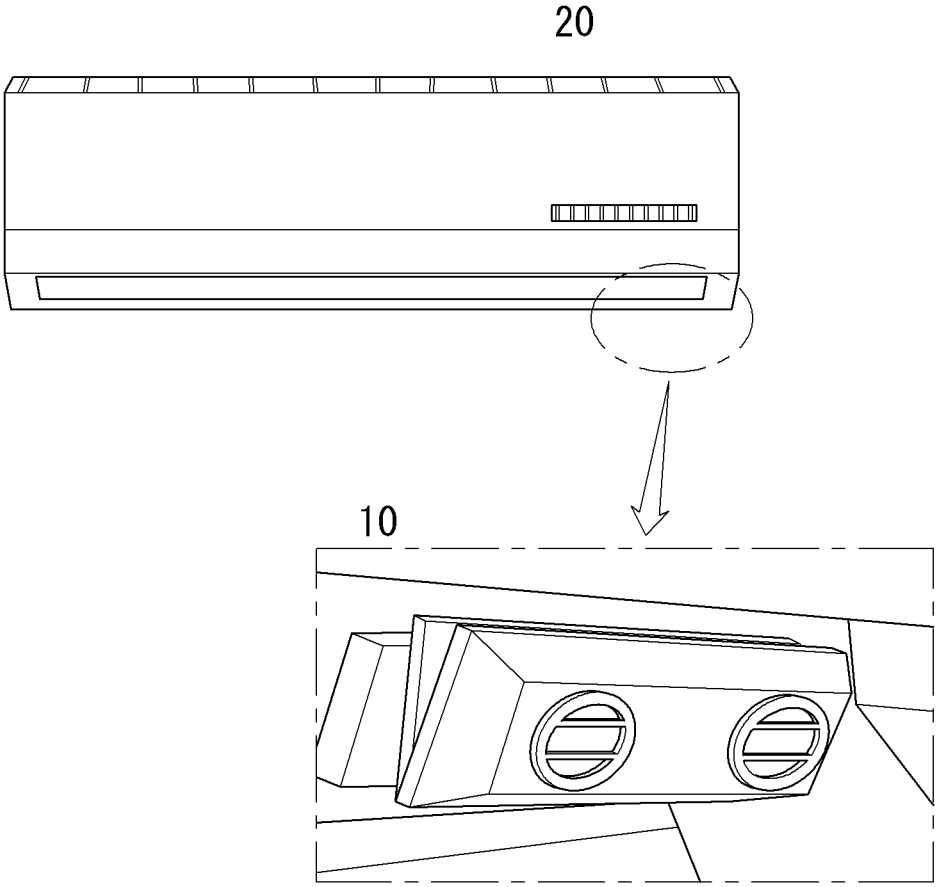
FIG. 1 is a front view illustrating a general wall mounting type air conditioner having an ionizer module mounted thereto.
Figure 2:
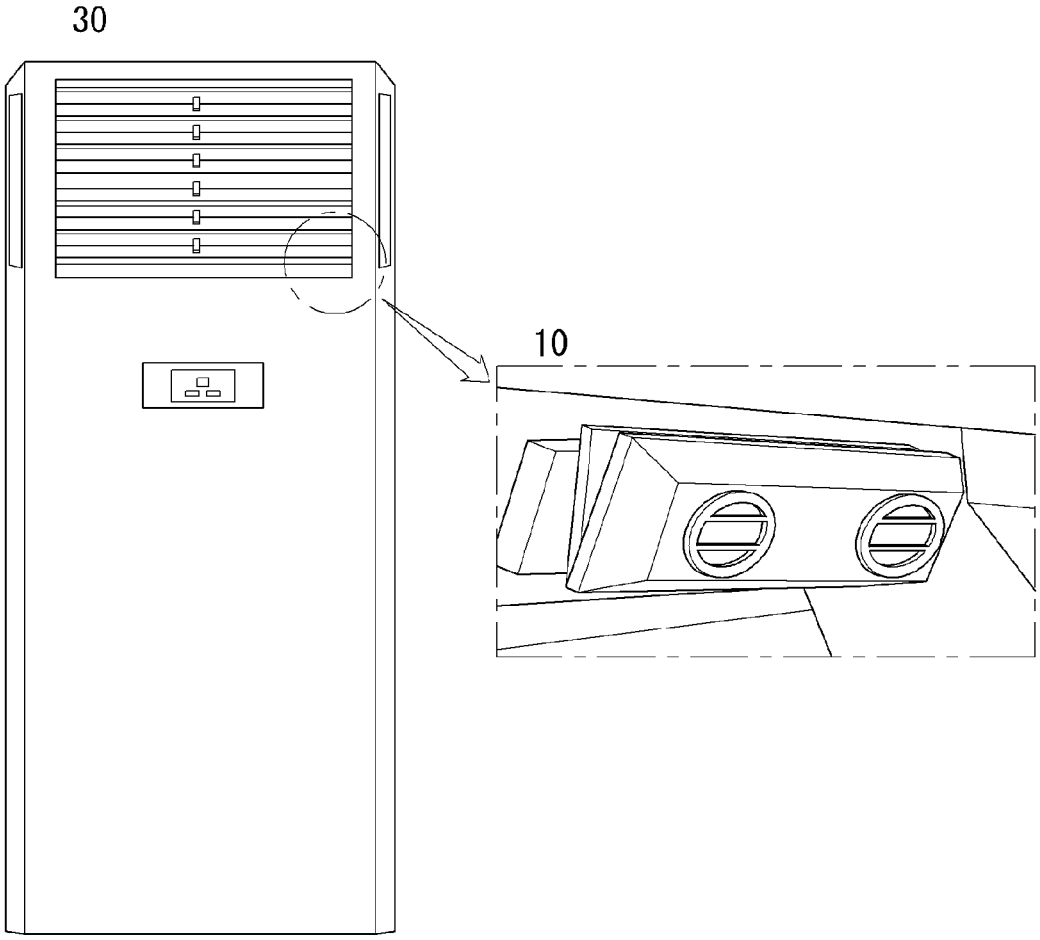
FIG. 2 is a front view illustrating a general stand type air conditioner having an ionizer module mounted thereto.
Figure 3:
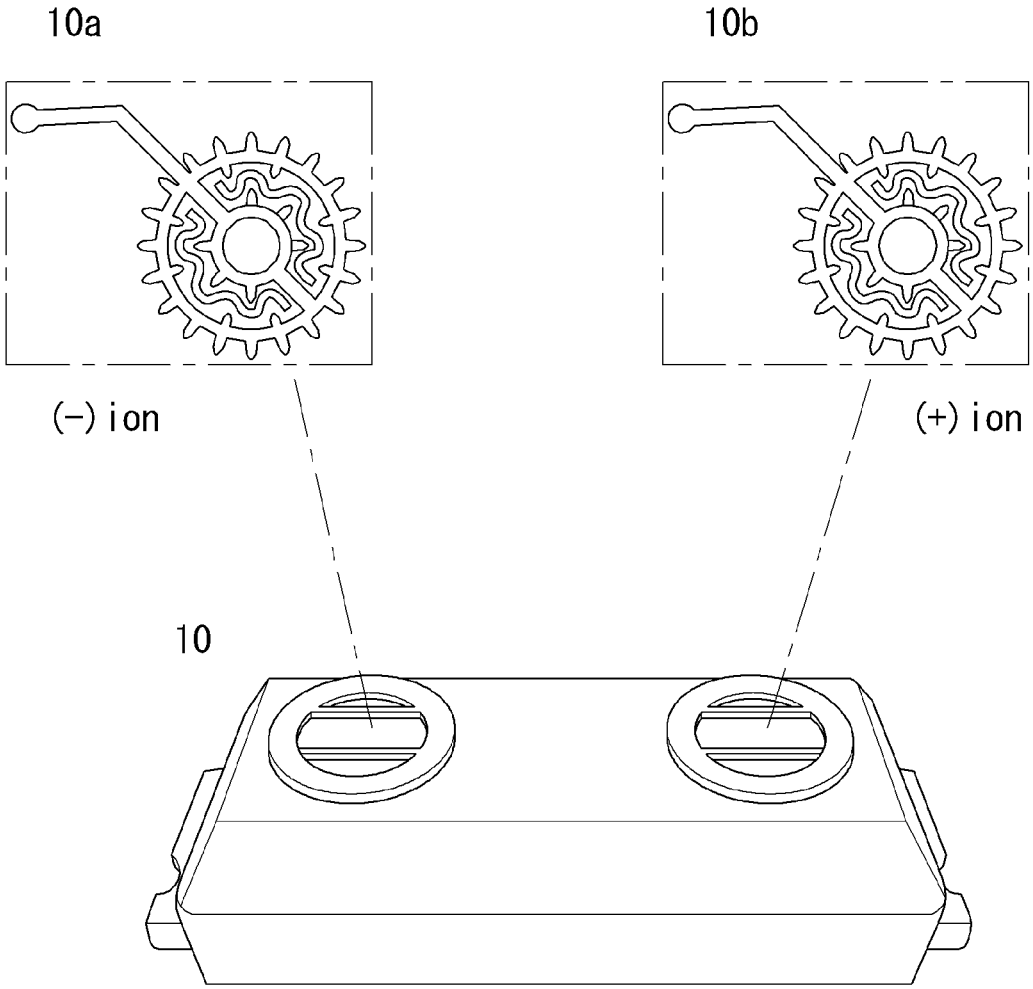
FIG. 3 is a perspective view illustrating an ionizer applicable to the present invention.

Referring to FIG. 3, the ionizer 10 may be in a small sized modular mode having an anion electrode 10*a* for generating an anion, and a cation electrode 10*b* for generating a cation.

Figure 4:
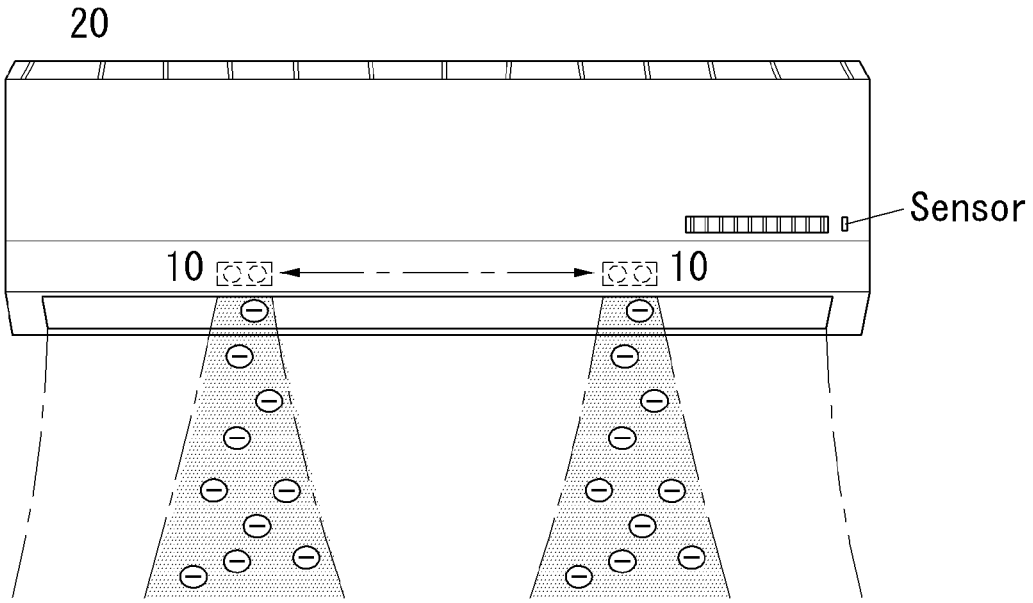
FIG. 4 is a front view illustrating an ionizer movable in a horizontal direction in an air conditioner in accordance with an embodiment of the present invention.

And, referring to FIG. 4, the modular ionizer 10 may be mounted in the vicinity of an outlet extended in a horizontal direction of the air conditioner, such that the modular ionizer 10 is movable along the air outlet in response to a signal, applied by a user, or from a human body sensor.

Figure 5:
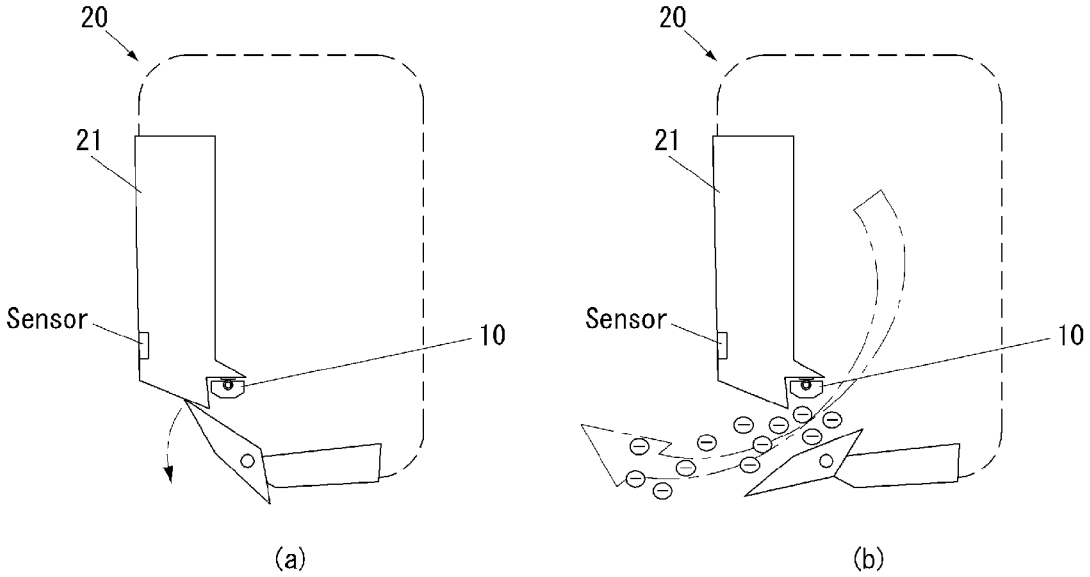
FIGS. 5A and 5B are schematic views illustrating an ionizer mounted to an inside structure in the vicinity of an air outlet in an air conditioner in accordance with an embodiment of the present invention.

And, referring to FIG. 5, if the ionizer 10 is mounted to, for an example, to a wall mounting type air conditioner 20, the ionizer 10 may be mounted to a structure on an inside of a front chassis 21 for making the ionizer 10 invisible from an outside of the air conditioner 20, and making the anions to be discharged following an air flow of the air conditioner being discharged through the outlet.

Figure 6:
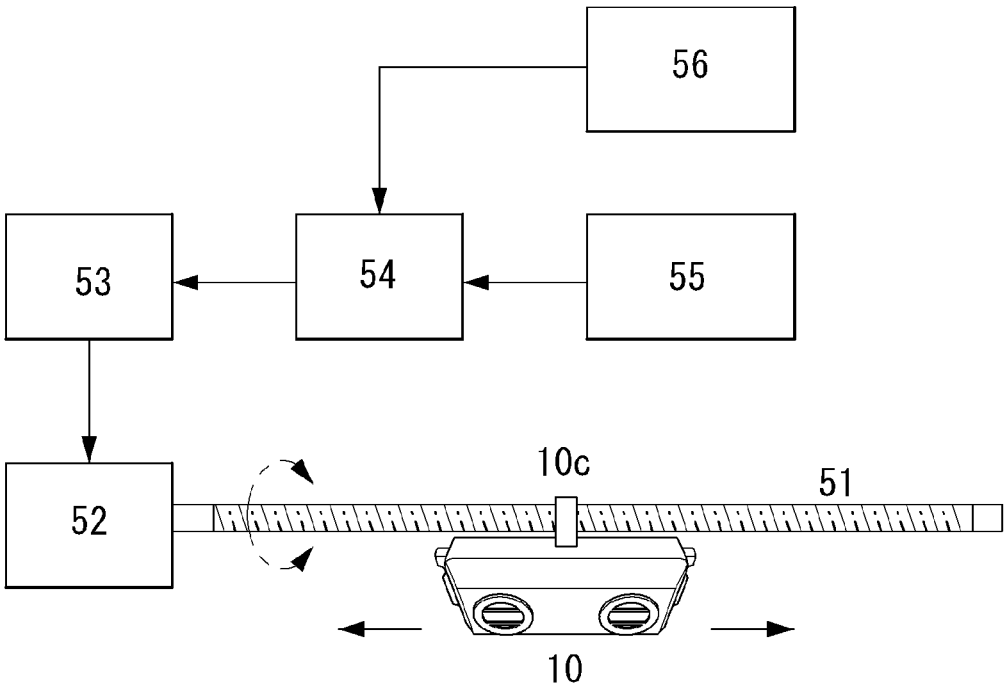
FIG. 6 is a block diagram of an air conditioner in accordance with an embodiment of the present invention.

Referring to FIG. 6, the ionizer 10 moves, for an example, along a rail 51 mounted in a horizontal direction, wherein the rail 51 may be a lead screw rotated by driving the motor 52.

And, referring to FIG. 6, since the lead screw has a helical groove (A thread) formed therein, and the ionizer 10 has link ring 10*c* with a needle or a rack formed therein to be engaged with the groove (Thread) in the lead screw, if the lead screw rotates, the ionizer 10 moves in a length direction of the rail.

The motor 52 may be, for an example, a step motor for controlling rotation of a rotor in steps to control a position of a component connected to the lead screw accurately, wherein, as shown in FIG. 6, a driving unit 53 which applies a voltage to the motor 52 is operated under the control of a controller 54, such as a microcomputer. The position of the ionizer 10 may be controlled with a number of pulses, i.e., a number of steps, applied to the step motor in a feed forward method, without using an additional position sensor.

And, the controller 54 may move the position of the ionizer 10 to any position by controlling operation of the driving unit 53 in response to a signal applied by the user received through an input unit 55, or may move the position of the ionizer 10 to a position in the vicinity of a direction in which a human body is sensed by controlling operation of the driving unit 53 in response to a body sensed signal sensed by a sensor unit 56.

For an example, the input unit 55 may include a remote controller receiver module or a key panel for making the driving unit 53 to perform an operation the user desires selectively, and the sensor unit 56 may include at least one of different types of human body sensors, such as an ultrasonic sensor, an infrared sensor, a heat sensor, and so on for automatic sensing of the position of the user.

And, referring to FIG. 5, the human body sensor may be mounted to the front chassis 21 of the air conditioner, for an example, to a front of the air outlet for sensing the position of the user.

Figure 7:
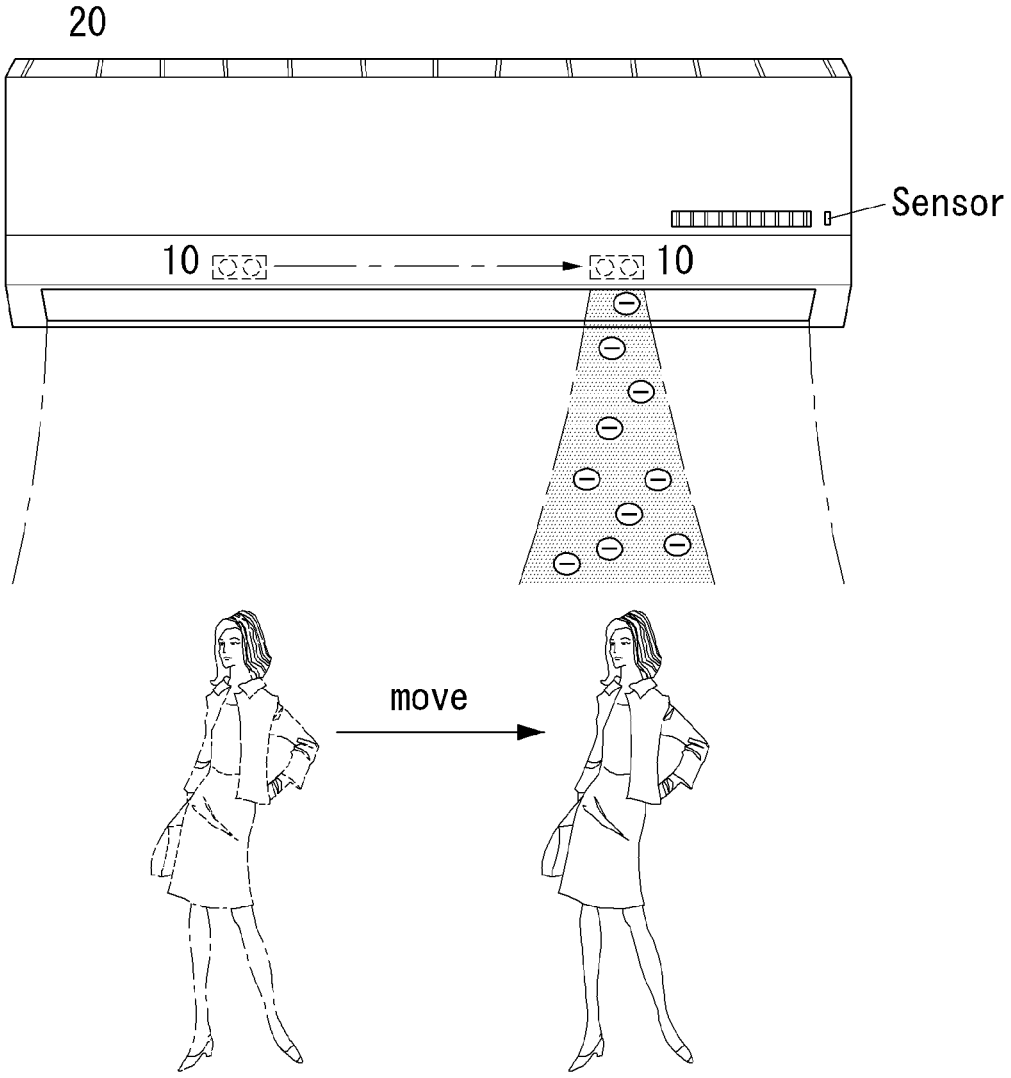
FIG. 7 is a schematic view of an ionizer in an air conditioner in accordance with an embodiment of the present invention illustrating the ionizer moving toward a user.

Referring to FIG. 7, upon reception of, for an example, the body sensed signal from the sensor unit 56, the controller 54 controls operation of the driving unit 53 in response to the human body sensed signal, to make a position of the ionizer 10 to direct the user.

For an example, if the user moves from a left side of the air conditioner to a right side thereof, the sensor unit 56 outputs the human body sensed signal corresponding to the movement of the user, and the controller 54 controls the operation of the driving unit 53, to control to vary the voltage to be applied to the motor 53.

According to this, the position of the ionizer 10 is moved from the left side to the right side along the rail 51 which rotates as the motor 53 is driven, making the ions to emit from the ionizer 10 toward the user moved to the right side, an ion effect the user feels can be improved, effectively.

And, if the signal applied by the user received through the input unit 55 is the remote controller signal corresponding to the position control on the ionizer, the controller 54 controls operation of the driving unit 53 to make the position of the ionizer 10 to move in response to the signal applied by the user.

The controller 54 sets a specific operation mode according to the signal applied by the user received through the input unit 55, wherein the specific operation mode may be any one of a plurality of operation modes set in advance for changing an ion generation rate, an air flow rate, or the like.

For example, if the specific mode is a water fall mode in which the ion generation rate is set to a highest, the controller 54 controls the operation of the ionizer 10 to increase the ion generation rate to a highest, as well as move the position of the ionizer 10 to a center, to diffuse the ions at the center intensively. In this time, the air flow rate of the air conditioner may be increased compared to a prior operation mode.

Opposite to this, if the specific mode is, for an example, a sleeping mode in which the ion generation rate is set to a lowest, the controller 54 controls the operation of the ionizer 10 to reduce the ion generation rate to a lowest as well as make the position of the ionizer 10 to move to the left side and the right side alternately at predetermined time intervals, to spread the ions generated thus to the left side and the right side widely while the user sleeps.

And, if a system power of the air conditioner is turned off, or an initializing operation is performed in response to the signal applied by the user, the controller 54 controls the operation of the driving unit 53 to move the position of the ionizer 10 to an initial point set in advance.

For an example, the controller 54 may make precise control on the step motor by moving the ionizer 10 to the closest one of the initial points and initializing a value of the step count counted up to now.

In order to make the controller 54 to be able to determine and control the position of the ionizer 10 even after supply of the system power fails suddenly during operation of the air conditioner, the controller 54 may control the driving unit 53 to move the ionizer 10 to one of the initial points when the power is supplied to the air conditioner or the power is changing from turn off to turn on. The controller 54 can determine the position of the ionizer 10 with the number of pulses, i.e., the number of steps, applied to the step motor through the driving unit 53 from the initial point.

In the meantime, the air conditioner may include a vane for controlling a direction of the air being discharged, and a vane driver for driving the vane, and, in order to control a distribution of ion concentration of a room, the controller 54 may control the position of the ionizer 10 interlocked with the direction of the vane, or strength of the air being discharged by the air conditioner or the ion generation rate of the ionizer 10 interlocked with the position of the ionizer 10.

If it is intended to distribute the concentration of the ions in the room uniformly, the controller 54 may control the driving unit 53 to reciprocate the ionizer 10 periodically, and, additionally, to make the vane of the air conditioner to swing, to distribute the ions generated by the ionizer far and uniformly, wherein, by synchronizing a reciprocating period of the ionizer 10 and a swing period of the vane, in an one to one ratio, in an integer ratio, or in a rational number ratio, it may also be possible to make the vane to have angles different from one another every time the ionizer 10 passes respective positions within a reciprocating section.

The controller 54 can grasp a range the user presents thereto from the human body sensed signal detected by the sensor unit 56 and control the driving unit 53 to make the ionizer 10 to reciprocate within the range grasped thus, or, in a state the ionizer 10 is set to reciprocate, control the ionizer 10 to increase the ion generation rate when the ionizer 10 passes the range, or control a fan (Not shown) which generates an air flow to increase a strength of the air flow or a flow rate of the air.

Moreover, the controller 54 can also move the position of the ionizer 10 taking the position of the user and the direction of the vane into account in a state the vane which controls a direction of the air being discharged from the air conditioner is set to swing, wherein it may be possible that the ions generated by the ionizer 10 can be focused on the user according to the air flow of which direction is controlled by the vane by making the ionizer 10 to position at a left side further than the user, if the vane rotates to direct the air being discharged to the right side, and by making the ionizer 10 to position at the right side further than the user, if the vane rotates to direct the air being discharged to the left side.

As has been described, the air conditioner with an ionizer of the present invention has the following advantage.

A range of ion diffusion can be controlled more efficiently, an ion effect the user feels can be improved by making to discharge the ions to a direction the user presents thereto.

While this invention has been described in connection with what is presently considered to be practical exemplary embodiments, it is to be understood that technical aspects of the present invention are not limited to the exemplary embodiments suggested in the specification, but, though a person of an ordinary skill in this field of art who understand the technical aspects of the present invention can suggest another exemplary embodiment by modifications, changes, removal, and addition of constituent elements within a range of technical aspects the same with the present invention, it may also be within a range of right of the present invention.

What is claimed is:

1. An air conditioner comprising:

an ionizer to generate ions mounted on a vicinity of an air outlet;

a carrier to move the ionizer; and a controller to control the ionizer and the carrier;

and further comprising a sensor to sense a position of a person, wherein the controller controls the position of the ionizer through the carrier in response to a sensing signal of the sensor.

2. The air conditioner as claimed in claim 1, wherein the air conditioner further comprises a front chassis, and the ionizer is mounted on an inside of the front chassis.

3. The air conditioner as claimed in claim 1, wherein the carrier includes a step motor and a lead screw, and the ionizer moves interlocked with the lead screw when the motor rotates the lead screw.

4. The air conditioner as claimed in claim 3, wherein the step motor and the lead screw are mounted on an inside of the air outlet.

5. The air conditioner as claimed in claim 3, wherein the controller controls the carrier to move the ionizer to an initial position when power is supplied to the air conditioner or the power is changed from turn off to turn on.

6. The air conditioner as claimed in claim 5, wherein the controller controls a position of the ionizer with a number of pulses applied to the step motor from the initial position.

7. The air conditioner as claimed in claim 1, wherein the sensor is one of an ultrasonic sensor, an infrared sensor, and a heat sensor.

8. The air conditioner as claimed in claim 1, wherein the sensor is mounted to a front of the air conditioner.

9. The air conditioner as claimed in claim 1, wherein the controller determines a range a person presents with respect to the air conditioner with the sensor, and controls the carrier to make the ionizer to reciprocate within the range determined by the controller.

10. The air conditioner as claimed in claim 9, wherein, if the controller sets the ionizer to reciprocate, the controller controls the ionizer to increase an ion generation rate when the ionizer passes the range the person presents with respect to the air conditioner.

11. The air conditioner as claimed in claim 9, wherein, if the controller sets the ionizer to reciprocate, the controller increases strength of air flow from the air conditioner when the ionizer passes the range the person presents with respect to the air conditioner.

12. The air conditioner as claimed in claim 1, further comprises an input unit, wherein an operation mode among a plurality of operation modes are set through the input unit.

13. The air conditioner as claimed in claim 12, wherein the operation mode is a water fall mode in which the controller controls an operation of the ionizer to set an ion generation rate to a highest, as well as move a position of the ionizer to a center of the air conditioner, to diffuse the ions at the center, and the controller sets an air flow rate of the air conditioner to be higher than other modes among the plurality of modes.

14. The air conditioner as claimed in claim 12, wherein the operation mode is a sleeping mode in which the controller controls an operation of the ionizer to set an ion generation rate to a lowest, as well as move a position of the ionizer to a left side and a right side of the air conditioner alternately at predetermined time intervals, to spread the generated ions.

15. The air conditioner as claimed in claim 1, further comprising a vane driver to drive a vane which controls a direction of air being discharged, wherein the controller controls the carrier to reciprocate the ionizer periodically, controls the vane driver to swing the vane periodically, and synchronizes a reciprocating period of the ionizer and a swing period of the vane at a predetermined ratio to distribute ion concentration uniformly.

16. The air conditioner as claimed in claim 1, further comprising a vane driver to drive the vane which controls a direction of the air being discharged, wherein the controller moves the position of the ionizer taking a position the person presents with respect to the air conditioner determined by the controller with the sensor and the controller takes into account direction of the vane in a state the vane is set to swing.

17. The air conditioner as claimed in claim 16, wherein, when the vane rotates to direct the air to a right side, the controller controls the carrier to position the ionizer at a left side, and, when the vane rotates to direct the air to the left side, the controller controls the carrier to position the ionizer at the right side.

* * * * *